US006760926B1

(12) United States Patent
Miller

(10) Patent No.: US 6,760,926 B1
(45) Date of Patent: Jul. 13, 2004

(54) SECURITY POCKET DEVICE

(76) Inventor: Raymond J. Miller, 1104 Campbell St., Youngstown, OH (US) 44502

( * ) Notice: Subject to any disclaimer, the term of this patent is extended or adjusted under 35 U.S.C. 154(b) by 38 days.

(21) Appl. No.: 10/216,704

(22) Filed: Aug. 12, 2002

(51) Int. Cl.[7] ..... A41D 27/20
(52) U.S. Cl. ..... 2/250
(58) Field of Search ..... 2/247–253, 69, 2/94, 102, 108, 69.5, 114, 115, 49.2, 105

(56) References Cited

U.S. PATENT DOCUMENTS

| | | | | | |
|---|---|---|---|---|---|
| 145,178 | A | * | 12/1873 | Hopkins | 2/252 |
| 1,355,044 | A | * | 10/1920 | Hjelm | 2/252 |
| 2,887,689 | A | * | 5/1959 | Conlan | 2/252 |
| 3,947,925 | A | | 4/1976 | Hargrave, Jr. | |
| 4,121,323 | A | | 10/1978 | Letostak | |
| 4,716,600 | A | | 1/1988 | Van Beek | |
| 4,825,922 | A | | 5/1989 | Rolfs | |
| 5,031,281 | A | | 7/1991 | Devylder | |
| 5,093,935 | A | * | 3/1992 | Countee, Jr. | 2/400 |
| 5,365,614 | A | * | 11/1994 | Perkins | 2/247 |
| 5,477,562 | A | | 12/1995 | Dixon | |
| 5,579,817 | A | | 12/1996 | Mader | |

* cited by examiner

*Primary Examiner*—Tejash Patel
(74) *Attorney, Agent, or Firm*—Harpman & Harpman

(57) ABSTRACT

A pocket loss prevention device for pockets to retain the contents of a pocket against loss or unauthorized removal. The device includes a flat rectangular insert of elastic material that is secured to the inside face of the pocket at the mouth of the pocket. An article to be secured is inserted into the pocket and up under the resilient insert. This will prevent articles such as a wallet from slipping out of the pocket until removed by a deliberate action of the user.

17 Claims, 4 Drawing Sheets

SECURITY POCKET DEVICE

BACKGROUND OF THE INVENTION

1. Technical Field

This device relates to lost prevention devices in general and specifically to devices for use on pockets that are found on garments by forming an open enclosure on the interior exterior of the garment.

2. Description of Prior Art

Prior art devices of this type have relied on a variety of different inserts and add ons to retain items positioned in pockets, see for example U.S. Pat. Nos. 3,947,925, 4,121,323, 4,716,600, 4,825,922, 5,031,281, 5,477,562 and 5,579,817.

In U.S. Pat. No. 3,947,925 a billfold protection device is illustrated having an inverted U-shaped plate like member being defined by a large contoured clip with a pair of flat leg members that straddle the button of the pocket and over the flap of the exterior of the pocket keeping the pocket closed.

U.S. Pat. No. 4,121,323 is directed towards a pocket protection device that extends from the belt of the user's pants and down to the pocket defining an object engagement wedge within the pocket.

U.S. Pat. No. 4,716,600 claims a pocket lost prevention guard having a flat resilient insert that is installed within the hem extending across the mouth of the pocket. An abrasive member is positioned midway on the insert to provide a resilient abrasive force against the object within the pocket preventing it from accidental dislodgement.

A security device for a wallet is disclosed in U.S. Pat. No. 4,825,922 in which a flexible resilient tab extends from the wallet and engages the interior surface of the pocket retaining the wallet within.

U.S. Pat. No. 5,477,562 is directed to an apparatus for retaining contents in the pockets of garments. A hollow hem is formed of the garments material folded over on itself with a resilient insert having a contoured configuration defining oppositely disposed bends inwardly from respective ends is inserted therein. The insert provides a resilient engagement action against the contents of the pocket maintaining same therein.

SUMMARY OF THE INVENTION

This invention relates to garment pockets which are modified to prevent the pocket's content from accidentally slipping out. The device of the invention comprises an elastic insert that is secured within the mouth of the pocket portion defining an opening along its lower edge under which the article can be selectively positioned.

DESCRIPTION OF THE PREFERRED EMBODIMENT

Figure 1:
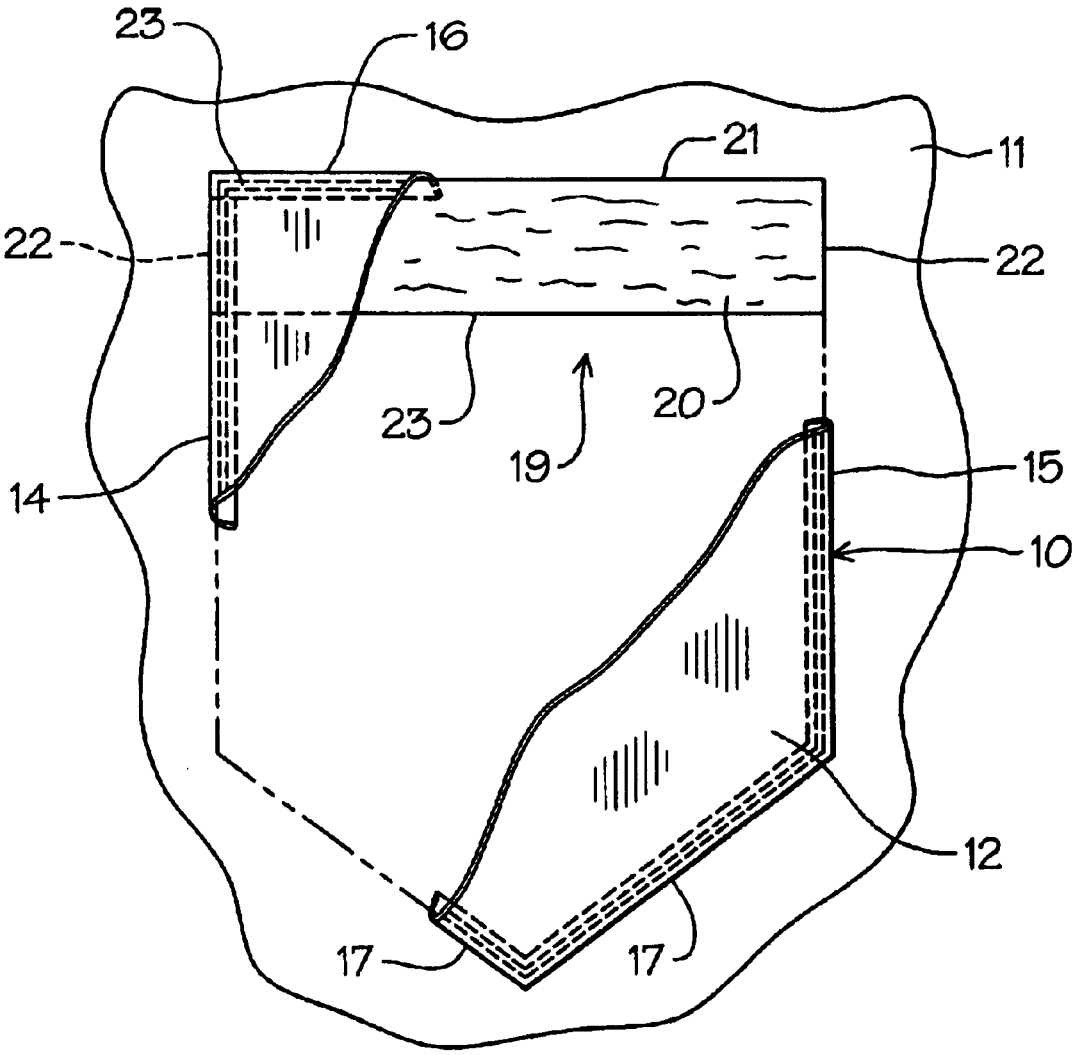
FIG. 1 is a front elevational view of a garment pocket having portions broken away with the retaining device of the invention positioned within.

Referring to FIG. 1 of the drawings, a pocket 10 can be seen formed on a garment 11. The pocket 10 has an outer portion 12 that is secured to the exterior surface 13 of the garment 11. The outer portion 12 is of a traditional design having oppositely disposed spaced parallel side edges 14 and 15, a top edge 16, and tapered bottom edges 17 that intersect at 18. The pocket 10 is formed by securing the outer portion 12 to the garment 11 along its respective side edges 14 and 15 and bottom edges 17 as will be well understood by those skilled in the art.

Figure 2:
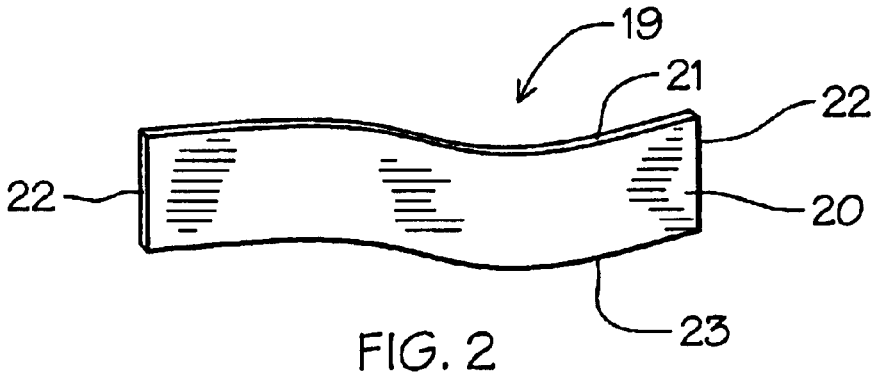
FIG. 2 is a perspective view of the invention before installation.

A pocket guard 19 of the invention is formed from a generally rectangular section of flat resilient elastic material 20 having a top edge portion 21, oppositely disposed side edge portions 22 and a bottom edge portion 23 in spaced relation to the top portion as best seen in FIG. 2 of the drawings. The pocket guard 20 is positioned along the top 16 of the pocket portion 10 so as to be extending transversely across the mouth of the pocket as it is defined thereby. The pocket guard 19 is secured in place by forming a hem 23 by folding the top edge 16 down over the top portion 21 of the pocket guard 19 and securing by sewing there along. The respective side edge portions 14 and 15 of the pocket portion 12 are folded over the pocket guard 19 respective side edge portions 22 and sewn in place as it is attached to the garment 11 as best seen in FIG. 1 of the drawings. The bottom edge portions 17 of the pocket portion 12 are secured in the usual manner to the garment.

Figure 3:
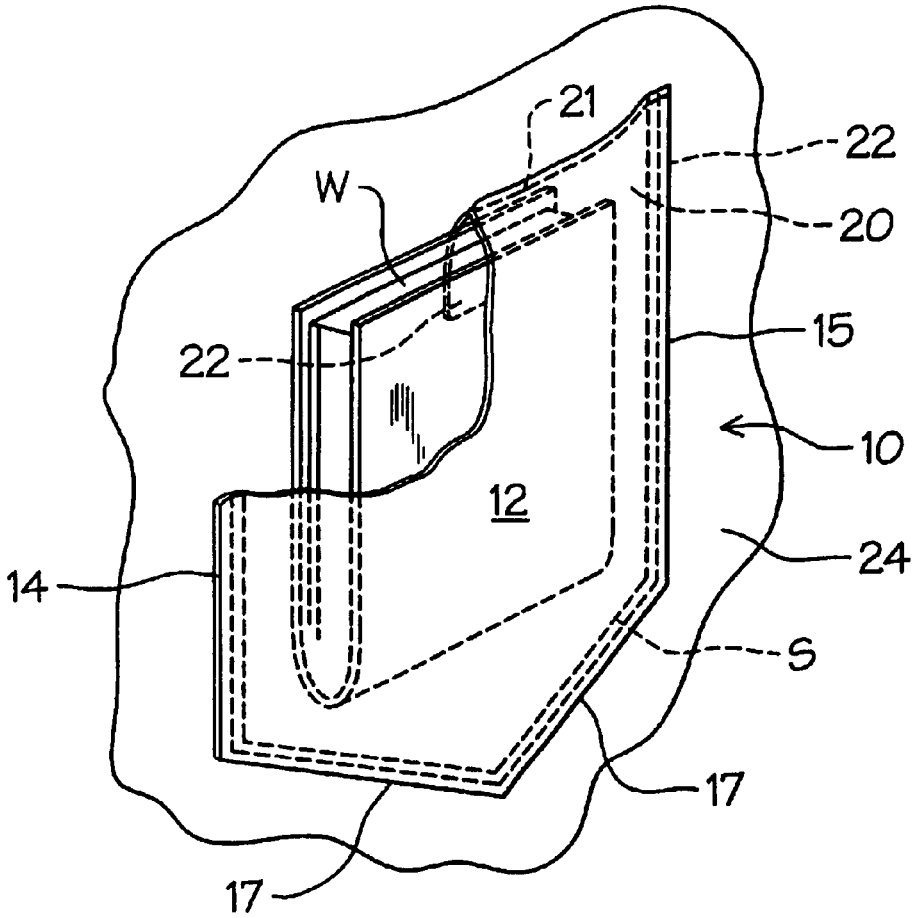
FIG. 3 is a partial perspective view of a garment pocket with the invention installed with portions broken away to illustrate the engagement with an actual article in the pocket shown in broken lines.
Figure 4:
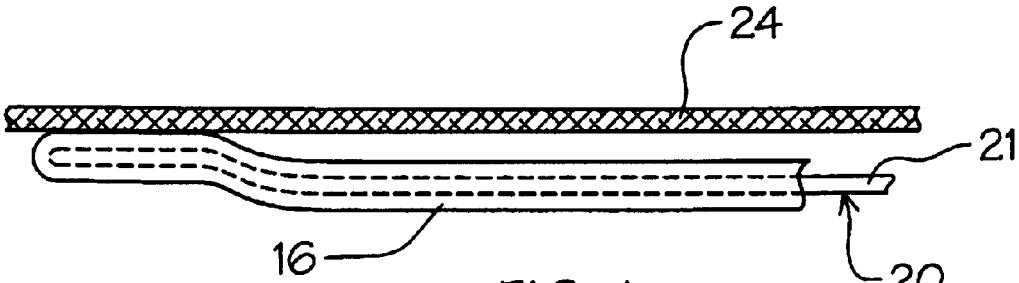
FIG. 4 is an enlarged partial cross-sectional view of the insert of the invention within a garment pocket.
Figure 5:
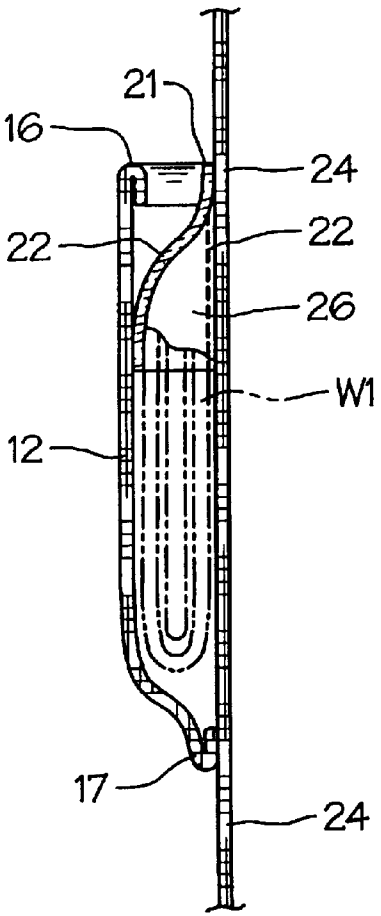
FIG. 5 is a partial cross-sectional view of a garment pocket with the insert of the invention engaged on an article within shown in broken lines.

It will be noted that the bottom edge 23 of the pocket guard 19 is therefore not attached allowing an article (such as a wallet W shown in broken lines) to be inserted within the pocket 10 in the usual manner and then positioned up and under the pocket guard 20 via the open bottom edge 23 as shown in FIGS. 3 and 5 of the drawings.

Figure 6:
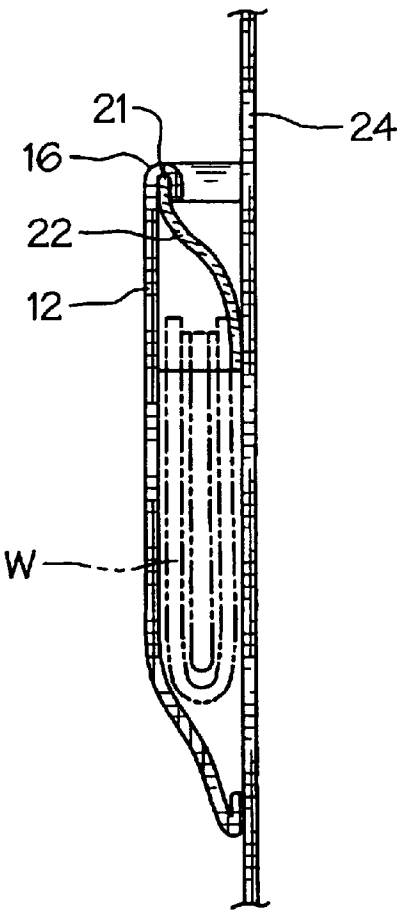
FIG. 6 is a partial front elevational view of an alternate form of the invention with portions broken away.

Referring to FIG. 6 of the drawings an alternate form of attachment of the pocket guard 19 can be seen wherein the pocket guard side portions 22 are not attached as hereinbefore described, but will still retain an article W within the pocket 10 given the nature of the elastic material used for the pocket guard 19 and the inherent frictional engagement against the interior surfaces of the pocket 10.

Figure 7:
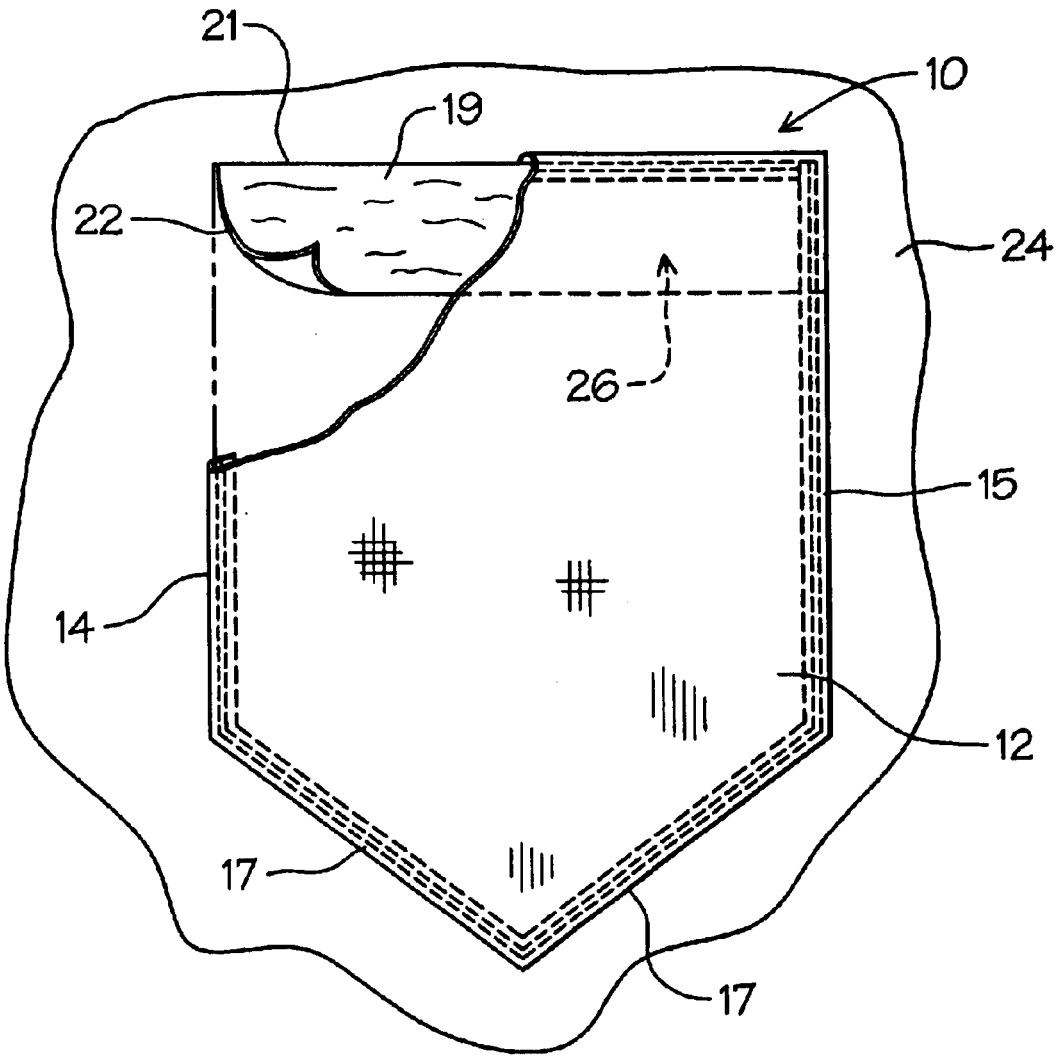
FIG. 7 is a front elevational view of an alternate attachment method for the primary form of the invention within the garments pocket.

Referring now to FIG. 7 of the drawings, a second alternate form of the invention can be seen wherein a pocket 10 has the pocket guard 19 secured to the garment surface 24 within the mouth of the pocket 10. In this example, the top edge portion 21 of the pocket guard 19 is sewn to the garment surface 24 co-planar with the upper free edge 16 of the outer portion 12. The side portions 22 of the pocket guard 19 are also secured to the garment suture 24 forming an article receiving area 26 there between illustrated by an inserted article W1 shown in broken lines therein.

In use, the pocket guard 19 allows for the insertion of an article W within the pocket and the overlaying of the elastic pocket guard 19 via its non-attached bottom edge 23.

To remove the article W, the user (not shown) places their finger in the pocket and under the elastic pocket guard 19 via its bottom edge portion 23 and then over the top of the article W within grasping and pulling it upwards as in the normal manner. The elastic pocket guard 19 yields under the direct lateral force and the wallet can be easily removed.

It is the nature of the pocket guard 19 that a deliberate action must be made by the user as described above to retrieve the article from under the pocket guard 19 and out of the pocket 10.

It is evident that other articles can also be slipped under the bottom edge 23 of the pocket guard 19 and thus be selectively retained within the pocket requiring a specific conscience action by the user to retrieve the retained article from within, as hereinbefore described.

Another advantage of the pocket guard 19 of the invention is to prevent unauthorized removal of valuable articles such as a wallet W from within the pocket 10 by the actions of a pick pocket (not shown) in which the user (not shown) is momentarily distracted by a bump and then the pick-pocket removes the article from the pocket un-noticed.

It will also be evident from the above description that various forms of material can be used for the pocket guard 19 which have different degrees of resiliency and structural stiffness thus in some applications such as the alternate form of securing the pocket guard 19 illustrated above wherein the side portions 22 were unattached, such a stiffened or thicker material of the pocket guard would help retain the device in the pocket without having to be secured as described in the preferred embodiment.

It will be obvious to those skilled in the art that various changes and modifications may be made therein without departing from the spirit of the invention.

Therefore I claim:

1. A lost prevention guard for retaining the contents in pockets of garments comprising in combination, a garment having a pocket formed therein, the pocket having a pocket portion with oppositely disposed side edges and interconnecting bottom edges stitched to the garment, said pocket having a free opened upper edge defining a mouth for insertion and removal of objects, said lost prevention guard comprises a resilient member extending along the mouth of the pocket, said resilient member having a top edge, oppositely disposed side edge portions extending there from and a bottom edge portion, said resilient member secured to the pocket by stitching along its top edge and side edges, means for resiliently engaging said resilient member over a portion of an article within said pocket.

2. The lost prevention guard set forth in claim 1 wherein said resilient retention member is comprised of an elastic fabric strip.

3. The lost prevention guard set forth in claim 1 wherein said resilient member is of a known length extending between said respective side edges of said pocket.

4. The lost prevention guard set forth in claim 1 wherein said resilient member is secured within a hem of fabric formed around respective side perimeter edges of said pocket and along its top edge defining an access flap.

5. The lost prevention guard set forth in claim 1 wherein said means for engaging said resilient member over a portion of an article within said pocket comprises, the free bottom edge portion of said resilient member yieldable from a first position adjacent said pocket portion to a second position in spaced relation to said pocket portion.

6. A lost prevention guard for retaining the contents of a pocket on a garment comprises, a resilient retaining member extending along the mouth of the pocket, said resilient retaining member having a top, oppositely disposed sides and bottom edge portions, said resilient retaining member secured along its top edge portion to said garment within a mouth defined of the pocket, said lost prevention guard comprised of an elastic fabric strip and means for selectively retaining an article within said pocket to said guard.

7. The lost prevention guard set forth in claim 6 wherein said elastic fabric strip is secured along its oppositely disposed side edge portions to said garment defining an access opening there between.

8. The lost prevention guard set forth in claim 6 wherein said resilient retaining member is of a known length equal to that of said mouth of said pocket.

9. The lost prevention guard set forth in claim 6 wherein said means for selectively retaining an article within said pocket comprises, a free bottom edge portion of said resilient retaining member.

10. A lost prevention guard for retaining the contents in pockets of garments comprising in combination, a garment having a pocket formed therein, the pocket having a pocket portion with oppositely disposed side edges and interconnecting bottom edges stitched to the garment, said pocket having a free opened upper edge defining a mouth for insertion and removal of objects, said lost prevention guard comprises a member extending along the mouth of the pocket, said member having a top edge, oppositely disposed side edge portions extending there from and a bottom edge portion, said member secured to the pocket by stitching along its top edge and side edges, means for selectively engaging said member over a portion of an article within said pocket.

11. The lost prevention guard set forth in claim 10 wherein said retention member is comprised of a fabric strip.

12. The lost prevention guard set forth in claim 10 wherein said member is of a known length extending between said respective side edges of said pocket.

13. The lost prevention guard set forth in claim 10 wherein said member is secured within a hem of fabric formed around respective side perimeter edges of said pocket and along its top edge defining an access flap.

14. The lost prevention guard set forth in claim 10 wherein said means for engaging said member over a portion of an article within said pocket comprises, the free bottom edge portion of said member yieldable from a first position adjacent said pocket portion to a second position in spaced relation to said pocket portion.

15. A lost prevention guard for retaining the contents of a pocket on a garment comprises, a retaining member extending along the mouth of the pocket, said retaining member having a top, oppositely disposed sides and bottom edge portions, said retaining member secured along its top edge portion to said garment within a mouth defined of the pocket, said lost prevention guard comprised of a fabric strip and means for selectively retaining an article within said pocket to said guard.

16. The lost prevention guard set forth in claim 15 wherein said fabric strip is secured along its oppositely disposed side edge portions to said garment defining an access opening there between.

17. The lost prevention guard set forth in claim 15 wherein said retaining member is of a known length equal to that of said mouth of said pocket.

* * * * *